US005275192A

United States Patent [19]

Lawson

[11] Patent Number: 5,275,192

[45] Date of Patent: Jan. 4, 1994

[54] FREEZE CONTROL VALVE

[76] Inventor: Roberta L. Lawson, 5756 Doonesbury Way, Tallahassee, Fla. 32303

[21] Appl. No.: 885,220

[22] Filed: May 20, 1992

[51] Int. Cl.[5] ..... E03B 7/10

[52] U.S. Cl. ..... 137/62; 137/79; 236/93 A

[58] Field of Search ..... 137/62, 61, 79; 236/58, 236/93

[56] References Cited

U.S. PATENT DOCUMENTS 2,165,171 7/1939 Zinkil ..... 236/93 B 3,446,226 5/1969 Canterbury ..... 137/62

FOREIGN PATENT DOCUMENTS 0256725 10/1990 Japan ..... 137/61

*Primary Examiner*—William E. Wayner

*Attorney, Agent, or Firm*—Oldham, Oldham & Wilson Co.

[57] ABSTRACT

In the Freeze Control Valve is situated a bellows that will contract at a temperature of 33 to 34 degrees F. thus triggering the valve to its position allowing the water or liquid to flow through a small discharge hole in the valve body, this in turn allows the water to heat to a higher temperature as it flows from the water line that are normally buried underground or an area that would have an above freezing temperature of 45 to 50 degrees F., the bellows at this temperature will expand, thus closing the Freeze Control Valve shutting off all exiting through the small discharge hole in the side of the valve body. When the water in the Freeze Control Valve drops again to 34 degrees F. the valve bellows repeats its action, this keeps the water from freezing.

4 Claims, 1 Drawing Sheet

FREEZE CONTROL VALVE

BACKGROUND OF THE INVENTION

This application relates to Freeze Control Valve that opens and closes in response to a preset bellows that respond to environmental temperature conditions, with no other operational sources except the outside temperature.

The invention application is for freeze control protection for all residential and commercial plumbing systems that are exposed to freezing conditions.

The Freeze Control Valve can be connected to a water line just behind the outside exposed bib or faucet, or screwed onto the bib or facet where the water hose connects, both applications can be preformed with the Do It Yourself Kit supplied with the Freeze Control Valve.

BRIEF DESCRIPTION OF THE DRAWINGS

The invention drawings are only for the purpose of illustrating the embodiments of the invention and are not to be construed as limiting the invention in anyway.

FIGURE NUMBER DESCRIPTION

Figure 1:
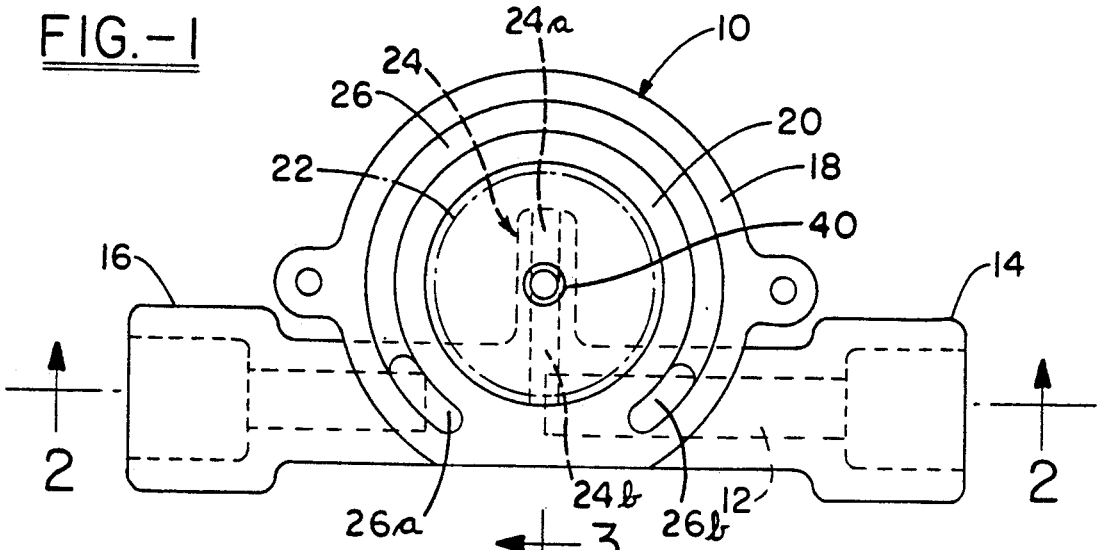
FIG. 1. is a cross-sectional of the top view of the Freeze Control Valve, showing walls and cavitures of the invention.
Figure 2:
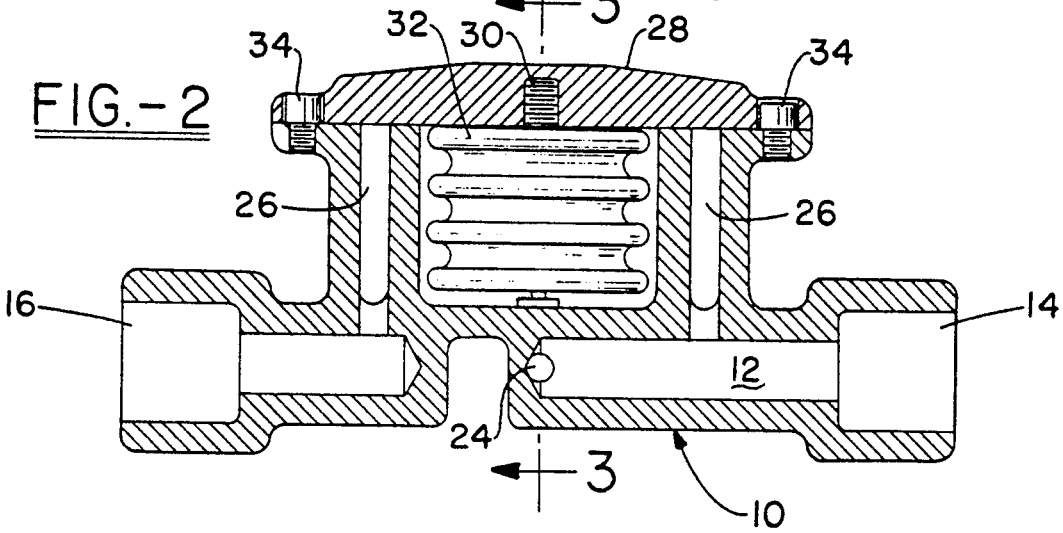
FIG. 2. is a cross-sectional side view of the Freeze Control Valve along line 2—2 of FIG. 1; cavitures and bellows of the present invention.

FIG. 1.
- 10 Freeze Control Valve body.
- 12 Valve chamber.
- 14 Pipe fitting for water exit.
- 16 Pipe fitting for water entry.
- 18 First wall portion.
- 20 Second wall portion.
- 22 Bellows caviture.
- 24 Water drain or discharge port.
- 26 Water flow cavity FIG. 2.
- 28 Valve body top or lid.
- 30 Bolt holding bellows to top.
- 32 Bellows body.
- 34 Screw fastening lid to valve body.

Figure 3:
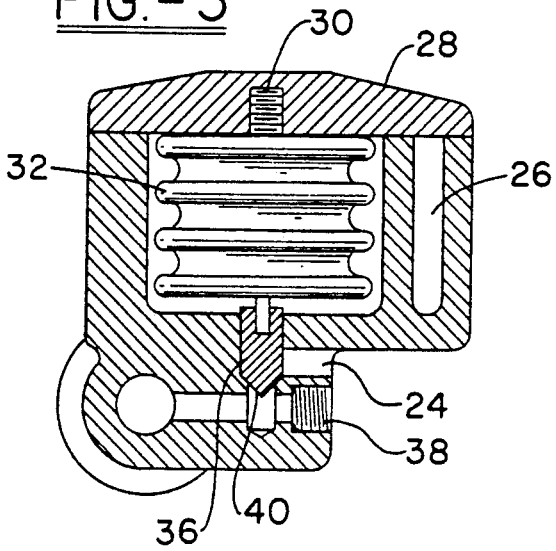
FIG. 3. is a cross-sectional end view of the Freeze Control Valve along line 3—3 of FIG. 2, with the bellows extended and the discharge valve closed.

FIG. 3.
- 36 Bellows discharge valve.
- 38 Discharge valve holding screw.
- 40 Discharge valve seat.

DETAILED DESCRIPTION

FIG. 1 shows the Freeze Control Valve body 10 having a valve chamber or second tube portion 12 with port 14 as a pipe fitting connection for water exit, also port 16 as a pipe fitting connection for the water to enter the freeze control valve, the valve body also has a drain or discharge port 24.

As further indicated in FIG. 1, the water drain or discharge port 24 includes an inner end **24*b*, which communicates with valve chamber or second tube portion 12. As further indicated in FIG. 1**, that inner end

**24*b* of water drain 24 is in further communication with the water cavity 26 which surrounds the bellows cavity or caviture 22**.

Figure 4:
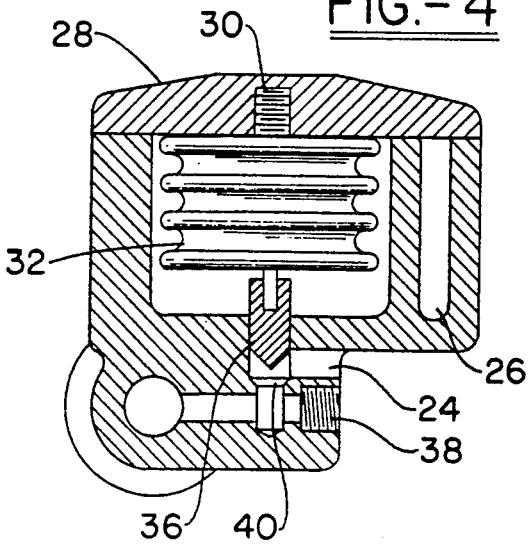
FIG. 4. is a cross-sectional end view of the Freeze Control Valve with the bellows contracted and the discharge valve open.

Further reference to FIG. 1 demonstrates that valve seat 40 is positioned transversely in the drain or water drain 24, the seat adapted to receive a bellows valve 36, shown in FIGS. 3 and 4, to close the drain 24 as the bellows 32 expands when the temperature in the bellows cavity ranges between 45° to 50° F. Bellows valve 36 also opens the drain 24 as the bellows 32 contracts when the temperature in the bellows caviture or cavity 22 drops to 34° F. When the drain is open, water escapes from a drain outlet hole in the outer end **24*b* of water drain 24** for drainage of water from the device, the latter action preventing freezing of water or other liquid in pipes or plumbing.

The valve housing includes a first wall portion or an inner wall portion 20 a second wall portion or second outer wall 18, this leaving a caviture or water cavity 26 for the water to flow through the valve body 10 so as to warm or cool the bellows caviture or cavity 22.

FIG. 2 shows the Freeze Control Valve body top or lid 28. This lid has a bellows bolt 30 screwed into it to hold the bellows body or bellows 32 in a ridged location so it will not quiver. Two screws 34 holds the top or lid 28 in a sealed location.

FIG. 3 shows the freeze Control Valve with the discharge valve 36 in a closed position, discharge valve seat 40 is held in location with discharge valve holding screw 38.

FIG. 4 shows the Freeze Control Valve with the discharge valve 36 in an open position this allowing water to flow out the water drain or discharge port 24 from water flow cavity or water cavity 26, that cavity shown in FIG. 4 to include inlet port **26*a* and outlet port 26*b***.

I now claim the invention to be:

1. A temperature sensitive device for connection to a water line, bibb, bibcock, or faucet, to prevent freezing of water or other liquids in pipes, plumbing, or the like, said device comprising:

a body portion having first and second ends, a pipe fitting and a first tube portion for water entry at the first end; and a pipe fitting and a second tube portion for water exit at said second end;

a housing contiguous with and positioned over the body, said housing having a first inner wall forming an enclosed bellows cavity and a second outer wall, said first and second walls forming a water cavity, the water cavity having an inlet port and an outlet port; the inlet port communicating with said first tube portion and the outlet port communicating with said second tube portion of the body; said water cavity surrounding the bellows cavity, for thermal transfer from the water cavity to the bellows cavity;

a bellows disposed in the bellows cavity for longitudinal movement therein, said bellows sensitive to temperature in the bellows cavity and the bellows having a valve at the bottom thereof;

a water drain having inner and outer ends, the inner end of said drain communicating with the second tube portion and a drain outlet hole in the outer end for drainage of water from the device;

a valve seat positioned transversely in the drain, the seat adapted to receive the bellows valve and close the drain when the bellows expands and to open the drain when the bellows contracts.

2. The temperature sensitive device of claim 1, wherein expansion and contraction of the bellows, with resultant closing and opening of the drain by the bellows valve, is controlled by thermal transfer from the water cavity to the bellows cavity.

3. The temperature sensitive device of claim 2, wherein the bellows expands to close the drain when the temperature in the bellows cavity is in a range between 45° to 50° F.

4. The temperature sensitive device of claim 3, wherein the bellows contracts to open the drain when the temperature in the bellows cavity is 34° F.

* * * * *